United States Patent [19]

Thompson

[11] Patent Number: 4,457,094

[45] Date of Patent: Jul. 3, 1984

[54] TRIGGER MECHANISM FOR A BOLT ACTION RIFLE

[76] Inventor: James G. Thompson, 4655 Butte Falls Hwy., Eagle Point, Oreg. 97524

[21] Appl. No.: 408,426

[22] Filed: Aug. 16, 1982

[51] Int. Cl.[3] ..... F41C 19/00; F41C 11/00

[52] U.S. Cl. ..... 42/69 A; 42/16

[58] Field of Search ..... 42/69 R, 69 A, 16

[56] References Cited

U.S. PATENT DOCUMENTS 1,184,950 5/1916 Hammond ..... 42/16

1,322,227 11/1919 Burton ..... 42/16

1,322,242 11/1919 Johnson ..... 42/16

*Primary Examiner*—Charles T. Jordan

*Assistant Examiner*—Ted L. Parr

*Attorney, Agent, or Firm*—James D. Givnan, Jr.

[57] ABSTRACT

A trigger mechanism wherein the trigger moves about a first fulcrum for sear release of the firing pin and a second fulcrum for further retraction of the sear away from the bolt assembly to permit rearward removal of the latter. The trigger is configured to provide two spaced apart pivots which coact with the underside of the rifle receiver. Sear retraction for bolt assembly release is accomplished with minimal trigger movement.

6 Claims, 2 Drawing Figures

TRIGGER MECHANISM FOR A BOLT ACTION RIFLE

BACKGROUND OF THE INVENTION

The present invention concerns a trigger mechanism wherein movement is about two pivot points to accomplish accentuated sear movement with only limited trigger movement.

In small calibre rifles, such as .22 caliber rifles, the sear serves multiple functions including release of the spring driven firing pin and that of a limit stop to limit rearward travel of the bolt assembly during opening of the rifle action. For firing pin release, only minimal vertical movement of a sear is required. Considerable additional vertical movement is required to withdraw the sear out of the path of the bolt assembly to permit rearward passage of same therepast during bolt removal from the rifle receiver.

In the manufacture of small rifles a problem has arisen with conventional trigger mechanisms which results from the accentuated sear and trigger movement required for bolt removal. Such accentuated movement of conventional trigger mechanisms necessitates the use of a trigger guard of unusual, out of proportion length which detracts from the rifle appearance. Further, the trigger opening in the stock must be of disproportionate length. Now popular with the public are .22 calibre rifles which simulate large calibre hunting rifles but which are made on a reduced scale. The use of a trigger guard of requisite length for a conventional trigger mechanism results in the guard being out of proportion with remaining rifle structure.

SUMMARY OF THE PRESENT INVENTION

The present invention is embodied within a rifle trigger mechanism wherein the trigger pivots about a first and then a second axis respectively for firing pin release and to permit bolt extraction from the receiver. The present trigger actuates a sear slidably disposed within a housing integral with the rifle receiver. The trigger is capable of incremental movement under light pressure for firing pin release with a heavier pull required for bolt removal. A frontal shoulder on the sear constitutes an abutment against which the firing pin abuts stopping the firing pin during bolt retraction to permit the firing pin to act as a casing ejector.

For purposes of bolt assembly removal as, for example, when the rifle is to be cleaned, it is necessary that the sear be retracted out of the path of the bolt. This additional sear travel or movement would require substantial added trigger travel were all trigger travel about the same axis. A marked reduction in trigger travel is attained in the present trigger arrangement by utilizing a second axis or pivot point remote from the sear to provide a greater arm acting on the sear.

Important objectives of the present trigger mechanism include the provision of a multifunction sear which in addition to firing pin release may be extracted from the bolt assembly to permit bolt assembly removal the latter accomplished without excessive trigger travel; the provision of a trigger mechanism wherein the trigger sequentially pivots about spaced apart fulcrums to provide different rates of travel of a trigger arm and the sear actuated by the trigger arm; the provision of a trigger mechanism accomplishing the foregoing objectives yet being of uncomplicated design and low assembly cost; the provision of a trigger mechanism wherein trigger travel for firing is about one axis requiring a certain force while further travel about a second axis requires a greater force; the provision of a trigger mechanism permitting the use of proportionate trigger guards and stock openings on scaled down rifle models.

DETAILED DESCRIPTION OF THE PREFERRED EMBODIMENT

Figure 1:
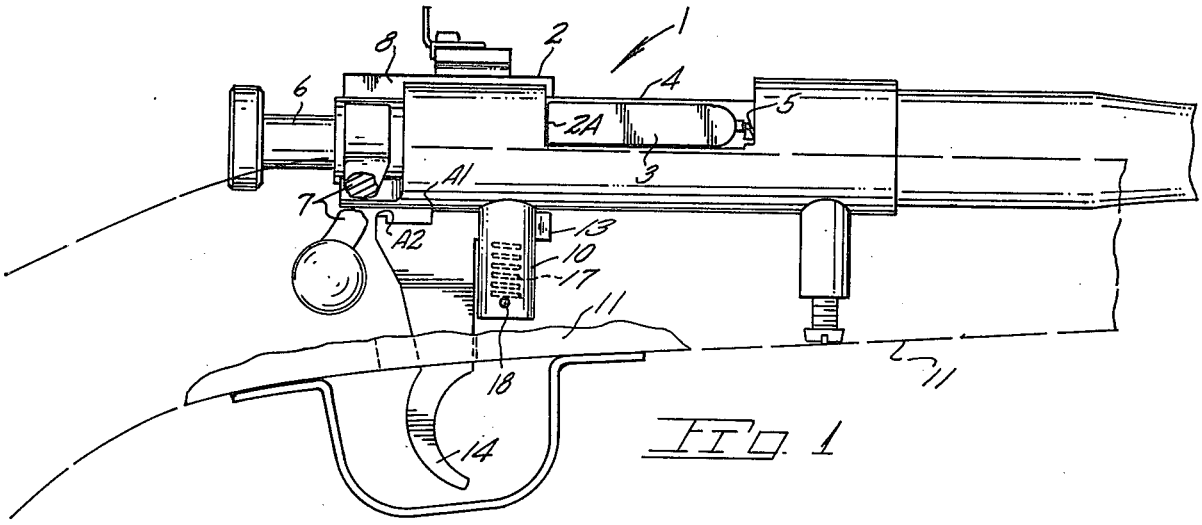
FIG. 1 is a side elevational view of a rifle receiver of a small calibre rifle with the stock shown in fragmentary and phantom form.
Figure 2:
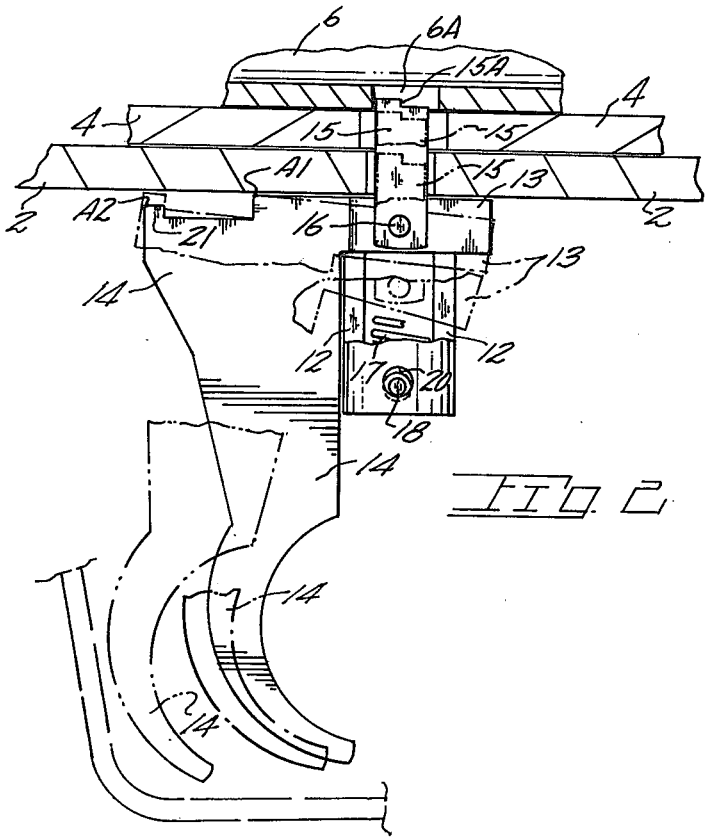
FIG. 2 is an enlarged sectional view of the trigger mechanism with the trigger shown in its normal position and firing pin release and bolt releasing positions.

With continuing attention to the drawing, the applied reference numeral 1 indicates the bolt assembly of a .22 calibre or other small calibre rifle slidably carried in the conventional manner within the rifle receiver 2. A locking lug 3 on a main bolt member 4 embodies both locking and extractor features presently the subject of a co-pending U.S. patent application Ser. No. 388,272, now U.S. Pat. No. 4,416,077. A casing extractor is at 5.

A firing pin at 6 is of tubular construction and houses a firing pin spring (not shown) which serves in the usual manner to drive the released firing pin into forceful contact with the casing end. A bolt assembly handle 7 serves in the conventional manner to permit rotation of bolt 4 about its axis to disengage locking lug 3 from a receiver edge 2A and to be aligned with an opening 8 of the split receiver to allow opening of the rifle action.

The receiver is equipped with a sear housing 10 which is received within a suitable aperture formed within the rifle stock 11. Sear housing 10 defines opposed slotted areas 12 within which may slide an arm 13 projecting forwardly and integral with a trigger at 14 of unitary construction. Trigger arm 13 carries a sear 15 having a bifurcated lower portion which straddles arm 13 and which is pinned thereto by a pivot pin 16. A helical spring 17 biases arm 13 and sear 15 upwardly. An opening at 6A in the firing pin receives the upper end of sear 15 which retains the pin against the action of the firing pin spring (not shown).

Movement of the sear to the single dot broken line position is accomplished by motion of trigger 14 about a first trigger fulcrum at A1 shown as a shoulder formed on the trigger in abutment with the underside of the rifle receiver. Such trigger movement is against the action of spring 17 confined within sear housing 10 by a shouldered retainer means shown as pin 18 confined within aligned housing openings 20.

A second trigger fulcrum or shoulder is indicated at A2 on a projection 21 on the trigger and about which trigger 14 and particularly arm 13 move when it is desired to remove the entire bolt assembly from the rifle receiver. Sear 15 is accordingly linearly retracted to the double dot broken line position by rearward displacement of the trigger to the double dot broken line position shown with such additional movement requiring an increased pull force. Accordingly, by increasing the effective length of trigger arm 13, accentuated downward displacement of sear 15 is accomplished without excessive rearward displacement of the trigger. The fulcrums at A1 and A2 are free to move to a minute extent forwardly along the underside of the receiver during rearward trigger movement.

The upper end of the sear is shouldered at 15A to provide a stop against which the firing pin abuts during rearward travel of the rifle bolt assembly during opening of the rifle action. The spent casing is carried at the forward end of the bolt assembly by an extractor during opening of the rifle action with ejection of the spent casing occurring upon the firing pin coming into abutment with sear shoulder 15A to cause the firing pin stud to project forwardly from the bolt and impart a dislodging force to the casting.

The pin 18 is shouldered at its ends and abuts the inner wall surfaces of housing 10 to confine the pin against lateral movement until the pin is elevated against the action of spring 17 into axial alignment with openings 20 whereupon the pin may be removed through one of said openings for maintenance purposes. The sear and trigger arm may then be removed downwardly from the sear housing.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A trigger mechanism for a bolt action rifle having a bolt assembly slidably carried in a rifle receiver, the bolt assembly including a firing pin, said mechanism comprising in combination, a trigger including a forwardly projecting trigger arm which may swing about multiple fulcrums, a sear pivotally coupled to said trigger arm and adapted for rectilinear movement in a path normal to the firing pin of the rifle bolt assembly, a sear housing disposed normal to the rifle bolt assembly and including resilient means biasing the trigger arm and sear to a normal raised position whereat the sear engages and restrains the firing pin of the rifle bolt assembly, said sear housing partially occupied by said trigger arm, said trigger including first and second spaced apart fulcrums coacting with the receiver of the bolt action rifle, said first fulcrum operable during initial rearward trigger movement resulting in linear sear movement for sear disengagement from the firing pin, said second fulcrum operable during continued trigger movement to further retract the sear in a linear manner out of the path of the rifle bolt assembly to permit removal of the bolt assembly from the rifle.

2. The trigger mechanism claimed in claim 1 wherein said trigger is of unitary construction and includes an upwardly directed projection embodying one of said fulcrums.

3. The trigger mechanism claimed in claim 1 wherein said first and second fulcrums are embodied in spaced apart shouldered portions formed on said trigger and contactible with the rifle receiver.

4. The trigger mechanism claimed in claim 1 wherein said sear housing defines a slotted area within which said forwardly projecting arm may swing to impart linear motion to the sear.

5. The trigger mechanism claimed in claim 4 additionally including retainer means transversely disposed through said housing and confining said resilient means in one direction, removal of said retainer means permitting removal of the sear and trigger arm from the sear housing.

6. The trigger mechanism claimed in claim 5 wherein said retainer means is a pin shouldered adjacent its opposite side for axial confinement within aligned openings in the sear housing.

* * * * *